United States Patent [19]

Tetenborg

[11] 4,006,576

[45] Feb. 8, 1977

[54] APPARATUS FOR PACKAGING FLAT FLEXIBLE WORKPIECES, PARTICULARLY BAGS OR SACKS, IN ENVELOPING BAGS

[75] Inventor: Konrad Tetenborg, Lengerich, Westphalia, Germany

[73] Assignee: Windmoller & Holscher, Lengerich, Westphalia, Germany

[22] Filed: Mar. 18, 1976

[21] Appl. No.: 668,305

[30] Foreign Application Priority Data

Mar. 20, 1975 Germany ..... 2512277

[52] U.S. Cl. ..... 53/124 B; 53/124 C; 53/124 D

[51] Int. Cl.[2] ..... B65B 63/02

[58] Field of Search ..... 53/124 B, 124 C, 124 D; 214/6 BA

[56] References Cited

UNITED STATES PATENTS

| | | | |
|---|---|---|---|
| 3,650,087 | 3/1972 | Brinkmeier et al. | 53/124 C |
| 3,824,759 | 7/1974 | Finn et al. | 53/124 D X |

*Primary Examiner*—Travis S. McGehee

*Attorney, Agent, or Firm*—Fleit & Jacobson

[57] ABSTRACT

In an apparatus for successively enveloping stacks of flat workpieces in bags, an inverted said bag is placed over a shaft in which a stack is located. A reciprocatable slide in the shaft comprising upwardly open U-section supporting bars for the stack presses the stack upwardly into the bag against a backing member disposed above the shaft, whereafter rod members enter the shaft in a lateral direction, are received in the U-sections of the supporting bars and are pivotable together with the back member to swing the enveloped stack away from the supporting bars and out of the shaft.

7 Claims, 2 Drawing Figures

Figure 1:
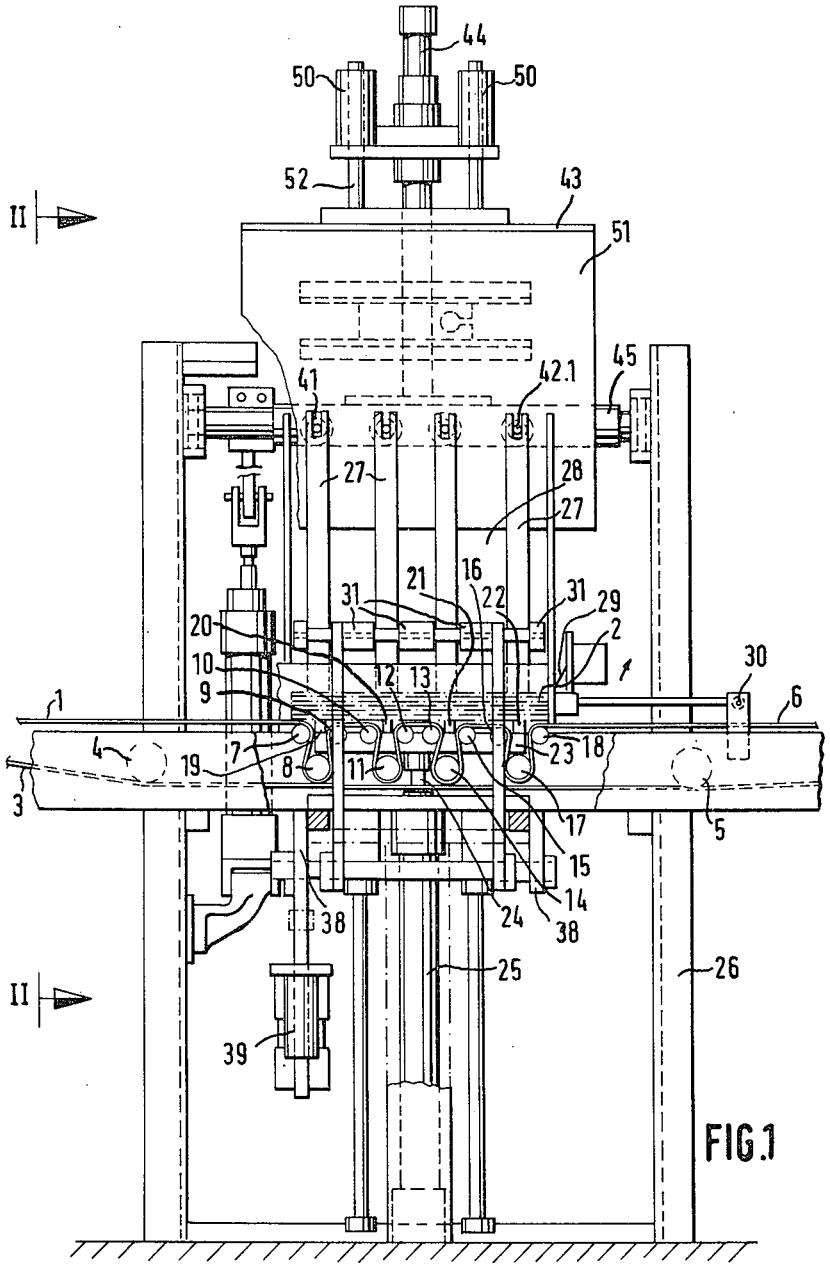

APPARATUS FOR PACKAGING FLAT FLEXIBLE WORKPIECES, PARTICULARLY BAGS OR SACKS, IN ENVELOPING BAGS

The invention relates to an apparatus for packaging flat flexible workpieces, particularly bags, sacks or packets of sacks, which are stacked in a shaft, in enveloping bags that are inverted over the shaft, comprising a slide reciprocatable in the shaft and a backing member disposed above the shaft.

In their prior Patent Application P 23 60 628.2, the Applicants have already suggested such an apparatus in which, after ejection of the stacked bags from the shaft, which pull the inverted enveloping bag from the shaft, the narrow sides of the enveloping bag are folded inwardly by forming plates and, after lowering of the slide, the longer sides of the enveloping bag are brought together by welding bars and welded together. It has been found that the stack of bags or sacks which, after lowering of the slide, is held only by the two forming plates, can sag downwardly in the region between the forming plates so that it is possible for individual bags or sacks to slip out, whereby the proper folding and welding of the longer sides of the enveloping bag is not ensured in all cases.

It is the aim of the present invention to provide an apparatus for packaging flat flexible workpieces in enveloping bags, in which the open side of the enveloping bag can be readily and accurately folded inwardly and welded without being impeded by the packaged workpieces.

According to the invention, this aim is achieved in an apparatus of the aforementioned kind in that the slide consists of supporting bars of upwardly open U-section steel and that retaining bars are provided at the top of the shaft and insertable therein, the retaining bars being insertable in the U-sections of the supporting bars when the slide is extended and being, together with their driving and supporting means as well as the supporting means of the backing member, fixed to a shaft which is pivotably mounted in the frame. In the apparatus according to the invention, the retaining bars inserted in the supporting bars of the slide prevent sagging of the stack pushed into the enveloping bag or curving of the lower workpieces of stack. By stack.By pivoting the shaft, for example by a hydraulically or pneumatically actuated piston-cylinder unit, the stack pushed into the enveloping bag is moved out of the region of the shaft for the stack so that the mouth of the enveloping bag that is to be closed is readily accessible. Upon insertion of the retaining bars, at least one side of the enveloping bag inverted over the shaft is pierced thereby but this does not detrimentally affect the durability and quality of the packaging. After pivoting, the stack of flexible workpieces pushed into the enveloping bag remains tightly clamped between the backing member and the supporting bars so that the parts of the side walls of the enveloping bag projecting beyond the stack can be folded inwardly in known manner and closed by adhesion or welding. The retaining bars are preferably pulled out only after closure of the enveloping bag has been completed so that a tight and compact package of the stack in the enveloping bag will result.

The slide can be lowered in the shaft as soon as the supporting bars have been inserted and taken over the task of supporting the stack instead of the slide. Lowering of the slide after insertion of the retaining bars offers the advantage that further stacks or workpieces can be stacked on the slide in the shaft so that the machine does not have to be stopped or execute an idle cycle. This avoids the need for arranging a plurality of packaging units adjacent one another.

Closure and taking away of the enveloping bag can be effected automatically or manually.

The upper end of the wall of the shaft is preferably provided with elongated holes through which the retaining bars pass on insertion. The limits formed by the elongated holes provide a counterbearing for the side wall of the enveloping bag that is to be pierced by the retaining bars, whereby the retaining bars can penetrate easily. The backing can also be formed by the front ends of the supporting bars of U-section steel if the slide pushes the stack to be packaged beyond the upper edge of the shaft.

A particularly simple drive for the retaining bars, which are preferably pointed at the front, is achieved if the retaining bars are formed by the piston rods of piston-cylinder pressure units.

In a further embodiment of the invention, a vertical guide plate is connected to the shaft, which supports the stack ejected from the shaft and on which the enveloped stack rests after pivoting. From this guide plate, which may be extended in the intended direction of conveying, the finished stack package can be readily pushed off for further transport.

The backing member may be connected to the piston rod of a piston-cylinder pressure unit fixed to the pivotally mounted shaft and the pressure in the piston-cylinder unit may be adjustable by a finely settable valve. In this way a constant force is exerted on the packet independently of the height of the stack in the enveloping bag.

After insertion of the retaining bars and lowering of the slide, the stack is held between the retaining bars and the backing member. In order that the guide elements of the retaining bars are not subjected to unnecessary wear under the force of the backing member during retraction of the retaining bars to their starting position, the backing member may be returnable to its end position before the retaining bars are retracted.

Figure 2:
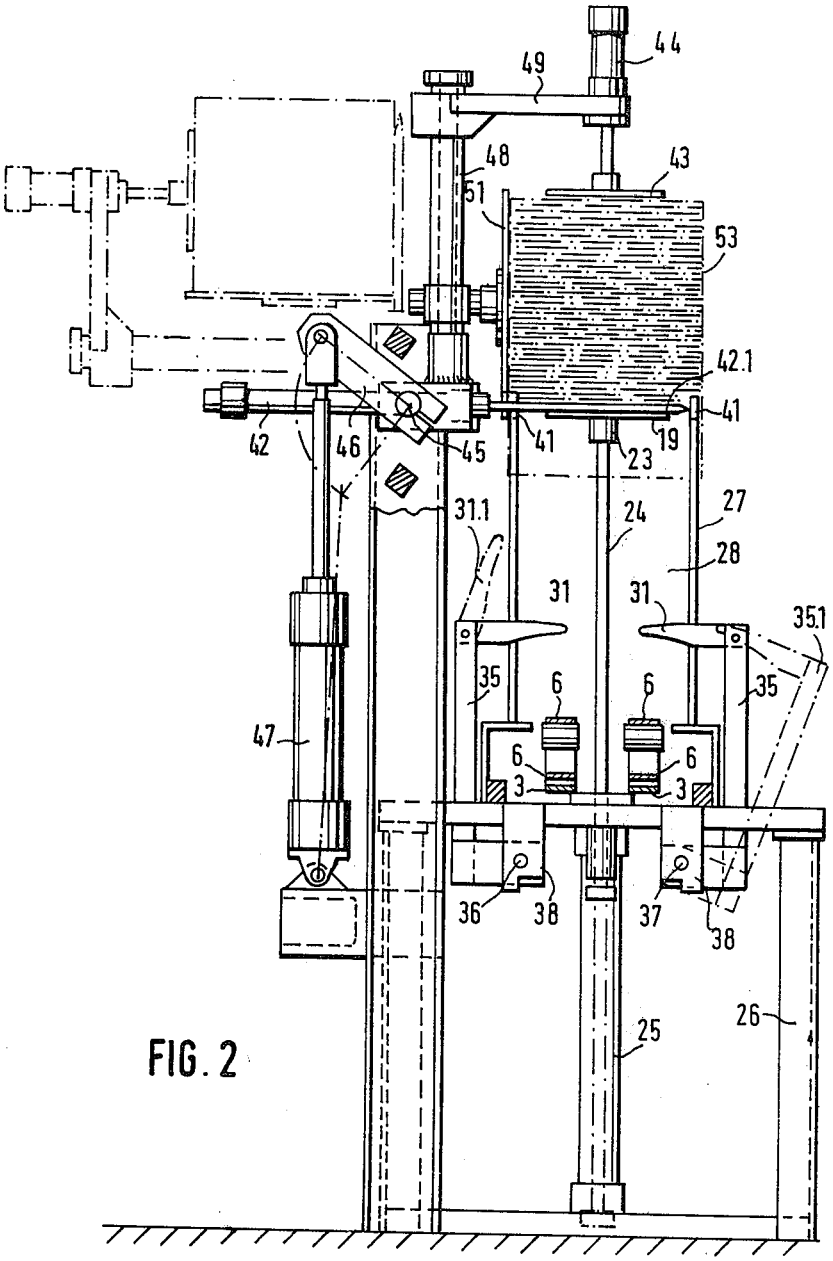

An example of the invention will now be described in more detail with reference to the drawing, wherein:

FIG. 1 is a diagrammatic side elevation of the supply and stacking apparatus, and FIG. 2 is a part-section of the apparatus taken along the line II—II in FIG. 1.

By means of a belt conveyor 1, transversely folded bags, sacks, packets of sacks or stacks 2 of such bags or sacks are supplied, for example from the left-hand side. The lower runs 3 of the belts pass over guide rollers 4 and 5 and the upper runs over guide rollers 7 to 18. Between the pairs of guide rollers 7, 9; 10, 12, 13, 15 and 16, 18 spaces are left in which supporting bars of U-section steel 19 to 22 are accommodated, of which the limbs are directed upwardly. In the case of this example, the supporting bars 19 to 22 extend transversely to the principal dimension of the transversely folded bags 2. They are held by a carriage 23 which is disposed in the direction of the principal dimension of the stack 2 of bags and is lowerable between the runs 6 of the belt conveyor 1. The carriage is mounted for lifting and lowering on a piston rod 24 of a piston-cylinder pressure unit 25. The U-shaped supporting bars 19 to 22 and the carriage 23 form the reciprocatable slide. The piston-cylinder pressure unit 25 is fixed to a frame 26 in which the guide rollers 4, 5 and 7 to 18 are also rotatably mounted. Also fixed to the frame 26 there is a plurality of vertically upwardly extending tongues 27 which form a shaft 28 having an outline substantially corresponding to the dimensions of the stack 2. Above the upper runs 6 of the belts 1 there is an abutment 29 which can be pivoted about a shaft 30 fixed to the frame. The stack 2 arriving on the runs 6 is stopped by the abutment 29 so that it is accurately positioned in the lower portion of the shaft 28. If the operator or an automatic sensing device, for example a light barrier, ascertains that the arriving bags were stacked to form an unusable stack, the abutment 29 can be lifted and the stack can be guided on the upper runs 6 further to the right to a waste collecting station (not shown). Plates 31 forming the support for an intermediate cassette are provided above the upper runs 6 for the purpose 69 of intermediate stacking. The plates 31 are arranged in pairs opposite one another and pivotably mounted on levers 35 fixed to shafts 36, 37. The plates 31 are laterally spaced from one another to an extent such that the supporting bars 19 to 22 can be reciprocated between them. The shafts 36, 37 are rotatably mounted in bearing blocks fixed to the frame. With the aid of levers (not shown), a piston rod of a piston-cylinder pressure unit 39 is hinged to the bearing blocks. By actuating the piston-cylinder unit, the levers 35 can be swung to the position 35.1 shown in broken lines.

The plates 31 are mounted on the levers 35 for upward swinging motion so that, if the piston-cylinder pressure unit 39 fails, free passage of the stack 2 in an upward direction is permitted. The plates are in this case swung to the position 31.1 shown in broken lines.

Individual smaller stacks 2 supplied by the upper runs 6 are stacked to form a larger stack on the intermediate cassette 31 by means of the reciprocatable slide 19 to 23 in so far that, during upward movement of the slide from the basic position to a first position, at which the slide is located above the intermediate cassette formed by the plates 31, the plates 31 are moved apart by the piston-cylinder pressure units 39, 40 and are returned to the starting position below the stack on the slide and the slide 19 – 23 is lowered again to its lower position.

At their end, the tongues 27 contain short recesses in the form of elongated holes 41. Rotatably mounted in the frame at substantially the level of these elongated holes 41 there is a shaft 45 to which there is fixed a lever 46 at the end of which the piston rod of a piston-cylinder unit 47 is hinged, the cylinder being pivotable with respect to the frame 26. In the case of this example, four piston-cylinder pressure units 42 are fixed to the shaft 45 and they are disposed horizontally in the basic position shown in FIG. 2. The length of their piston rods 42.1 substantially corresponds to the width of the stack 2 of bags. Fixed to the shaft 45 there is also a tubular post 48 on which a holder 49 is adjustable for height and can be fixed in position. The holder 49 carries a piston-cylinder pressure unit 44 and guides 50. A backing member 43 having dimensions substantially corresponding to the size of the slide formed by the supporting bars 19 to 22 and the carriage 23 is fixed to the piston rod of the piston-cylinder pressure unit 44 in registry with the piston rod 24 above the slide and is guided by pins 52 in the guides 50 so that it can also take up forces that are eccentric with respect to the piston rod of the piston-cylinder pressure unit 44. A guide plate 51 is also fixed to the tubular post 48. After the stacking of bags or sacks on the plates 31 to form a stack of the desired height, an enveloping bag 53 is pushed over the shaft 28 and the stack is pressed against the base of the enveloping bag 53 by the slide which moves to its uppermost position for this purpose, whilst the backing member 43 imparts to the enveloping bag 53 the counterforce that is necessary for compression, the pressure of the pressure medium of the piston-cylinder pressure unit 44 being adjustable by a finely settable valve. This exerts on the package a constant force that is independent of the height of the stack in the enveloping bag. The guide plate 51 is positioned with respect to the enveloping bag 53 so that the latter is lightly contacted by the guide plate 51. After compression of the stack, the piston-cylinder pressure units 42 are actuated so that their piston rods 42.1, of which the ends are pointed for this purpose, pierce through the wall of the enveloping bag and arrive beneath the stack by entering the upwardly open section of the supporting bars 19 to 22. The stroke of the piston-cylinder pressure units 42 may be set so that the tips of the retaining bars 42.1 also pierce the second wall opposite the first wall of the enveloping bag. Penetration of the retaining bars 42.1 through the first wall of the enveloping bag 53 is enhanced by the elongated holes 41 of the tongues 27, the tongues being supported on the supporting bars 19 to 22. The slide 19 to 22 is now retracted to its rest position and new stacks can be stacked on the intermediate cassette by means of the slide. The piston-cylinder pressure unit 47 is now actuated so that the shaft 45, and with it the retaining bars 42.1 as well as the backing member 43, are swung through about 90°. This pulls the mouth of the enveloping bag from the tongues 27, which are resiliently yielding. After reaching the horizontal position, the enveloping bag is closed. This can be effected by folding the edges of the enveloping bag inwardly and manually adhering same by means of an adhesive tape. Thereafter the enveloping bag is pushed further along the guide plate 51 which may be extended in the conveying direction, and a new enveloping bag is inverted over the shaft. Finally, the backing member 43 and the retaining bars 42.1 are swung back to their starting position and are ready for the packaging of the next stack.

I claim:

1. Apparatus for packaging flat flexible workpieces, particularly bags, sacks or packets of sacks, which are stacked in a shaft, in enveloping bags that are inverted over the shaft, comprising a slide reciprocatable in the shaft and a backing member disposed above the shaft, characterised in that the slide consists of supporting bars (19 to 22) of upwardly open U-section steel, and that retaining bars (42.1) are provided at the top of the shaft and insertable therein, the retaining bars being insertable in the U-sections of the supporting bars when the slide is extended and being, together with their driving and supporting means (42) as well as the supporting means (48, 49) of the backing member (43), fixed to a shaft (45) which is pivotably mounted in the frame (26).

2. Apparatus according to claim 1, characterised in that the upper end of the wall of the shaft is provided with elongated holes (41) through which the retaining bars (42.1) pass on insertion.

3. Apparatus according to claim 1, characterised in that the shaft is bounded by tongues (27).

4. Apparatus according to claim 1, characterised in that the retaining bars (42.1) are pointed at the front.

5. Apparatus according to claim 1, characterised in that the retaining bars (42.1) are formed by piston rods of piston-cylinder pressure units (42).

6. Apparatus according to claim 1, characterised in that a guide plate (51) is connected to the shaft (45), which supports the stack ejected from the shaft and on which the enveloped stack rests after pivoting.

7. Apparatus according to claim 1, characterised in that the backing member (43) is returnable to its end position before the retaining bars (42.1) are retracted.

* * * * *